United States Patent [19]

Harris

[11] 4,005,944

[45] Feb. 1, 1977

[54] TAMPING APPARATUS

[76] Inventor: Marvin K. Harris, Sheldahl, Iowa 50243

[22] Filed: Aug. 6, 1975

[21] Appl. No.: 602,256

Related U.S. Application Data

[62] Division of Ser. No. 369,891, June 14, 1973, Pat. No. 3,908,292.

[52] U.S. Cl. ..... 404/133

[51] Int. Cl.[2] ..... E01C 19/34

[58] Field of Search ..... 404/133, 113; 172/221, 172/224, 225; 37/142.5, DIG. 3

[56] References Cited

UNITED STATES PATENTS

| | | | |
|---|---|---|---|
| 2,844,006 | 7/1958 | Lutz et al. | 404/133 |
| 3,427,939 | 2/1969 | Braff et al. | 404/133 |
| 3,636,834 | 1/1972 | Waschulewski et al. | 404/133 |
| 3,787,135 | 1/1974 | Layton | 404/113 |
| 3,909,149 | 9/1975 | Century | 404/133 |

*Primary Examiner*—Henry S. Jaudon

*Attorney, Agent, or Firm*—Henderson, Strom & Sturm

[57] ABSTRACT

An articulated tractor-type vehicle having a supporting frame including a pivotable boom to which a steerable wheel is mounted. The supporting frame carries an adjustably positionable tamping unit and an adjustably positionable trench filling unit such as a drag conveyor to provide simultaneous filling and tamping of a trench. A novel reciprocating tamping unit having increased effectiveness and reduced shock transmission is described.

8 Claims, 22 Drawing Figures

Fig. 8
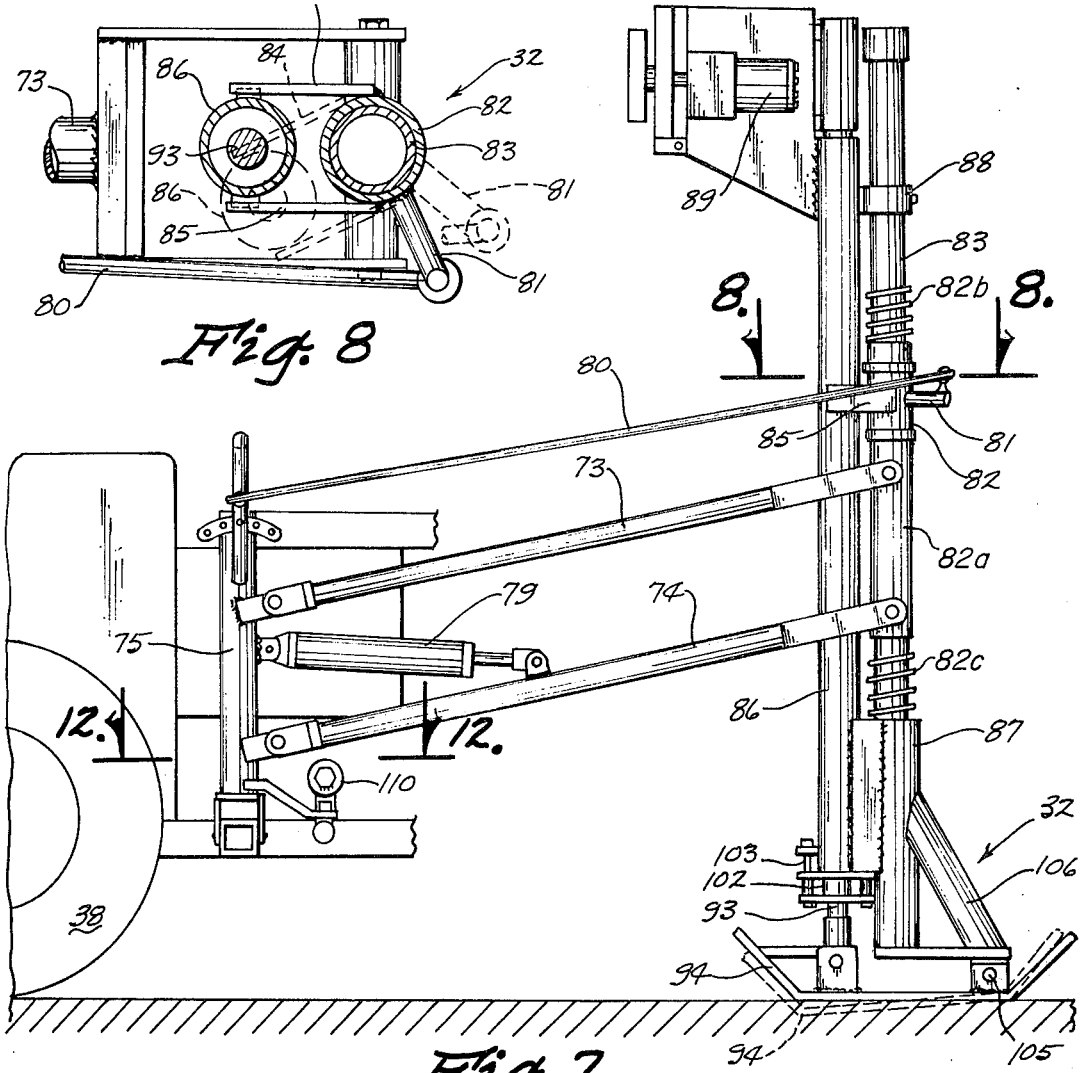
Fig. 7
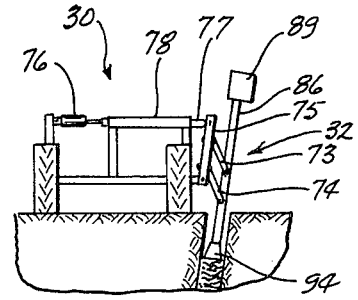
Fig. 10
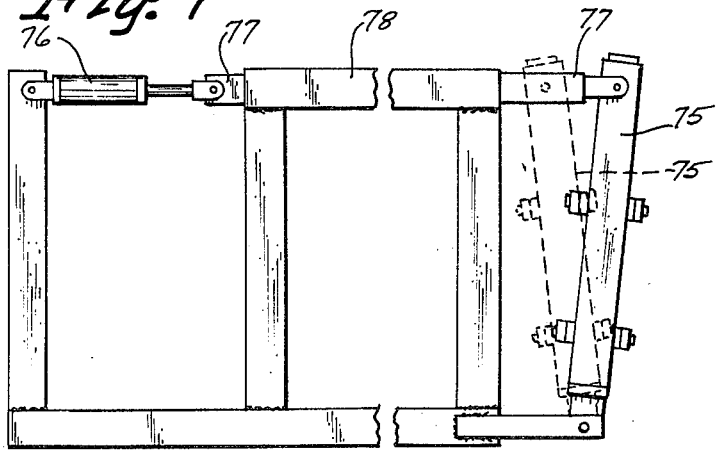
Fig. 9

TAMPING APPARATUS

This application is a division of application Ser. No. 369,891 filed June 14, 1973, now U.S. Pat. No. 3,908,292.

BACKGROUND OF THE INVENTION

1. Field of the Invention

This invention relates to equipment for refilling and packing a trench or ditch, and more particularly to equipment comprising a movable supporting frame carrying a reciprocating tamping device and a drag conveyor, and to improved tamping devices and drag conveyors.

In many types of construction work, and particularly in laying pipelines, cables, or the like, a long trench or ditch is required, and the trench must be refilled and packed after the desired material has been placed therein. The refilling and packing of such a trench has heretofore generally been done using one machine for filling and a different machine for packing, or manually, or by a combination of manual and machine operations.

Frequently, the trench to be refilled and packed is along uneven or difficultly accessible terrain, such that a filler and packer to be most useful should be capable of working on uneven terrain, and from either side of the trench.

2. Description of the Prior Art

Numerous patents have been issued for machine-carried reciprocating tamping devices for use in packing a refilled trench or the like. U.S. Pat. Nos. 2,844,006; 3,128,682; 3,327,598; 3,376,799; 3,478,656 and 3,497,017 are exemplary of such devices. The machines described therein are to varying degrees useful in compacting a refilled trench, but they do not provide for refilling the trench, such that a separate filling device, or a manual operation, is required. These prior art tamping devices usually transmit an undesirable amount of shock back to the carrying vehicle and its operator.

U.S. Pat. No. 2,902,908 describes the combination of a scraper blade and a tamping unit mounted on a movable supporting frame. However, the combination described in the above patent is intended primarily for use in road building, and is neither intended nor suited for refilling and packing a trench.

Articulated vehicles for supporting ground-working implements are described in U.S. Pat. Nos. 2,788,858; 3,040,510 and 3,704,754. No. 3,704,754 describes a tractor having steerable front wheels attached to a boom pivotable relative to the rear frame section, and in certain respects is similar to the articulated vehicle described herein.

Prior to the present invention, there was no satisfactory device available which could simultaneously fill and pack a trench, and particularly there was no such device which could operate on uneven and obstructed terrain.

SUMMARY OF THE INVENTION

According to the present invention, a device is provided which can fill and pack a trench simultaneously, and can perform both operations from a variety of positions. The device of this invention comprises the combination of an articulated vehicle providing a supporting frame for both a tamping unit and a filling unit.

In accordance with another aspect of the invention, a novel tamping unit is provided.

In accordance with still another aspect of the invention, a novel filler unit comprising a drag conveyor which can be pivoted to either side of a supporting axis is provided.

The articulated vehicle comprising a part of this invention includes a supporting frame from which the tamping unit and filling unit are mounted for adjustable positioning relative thereto. A boom pivotable relative to the main vehicle frame supports a steerable wheel, and also supports the filling unit. The relative positions of the main vehicle frame, the pivotable boom, the tamping unit and the filling unit are adjustably controlled.

It is therefore an object of the present invention to provide a novel device capable of simultaneously filling and packing a trench.

It is another object to provide a novel tamping unit.

It is another object to provide a novel filling unit comprising a drag conveyor adjustably mounted to a supporting frame.

It is another object to provide a novel combination of an articulated vehicle, a tamping unit, a filling unit, and a supporting frame adjustably mounting the tamping unit and the filling unit on the vehicle.

That the above as well as additional objects and advantages are provided by the present invention will become apparent upon consideration of the following detailed description of a preferred embodiment thereof.

BRIEF DESCRIPTION OF THE DRAWINGS

FIG. 7 is a side elevation showing the tamper and its support, taken along the line 7—7 of FIG. 2.

FIG. 8 is a cross-section taken along the line 8—8 of FIG. 7.

FIG. 9 illustrates part of the tamper support and its associated mechanism for applying side tilting to the tamper, taken along the line 9—9 of FIG. 2.

FIG. 10 illustrates the utility of the side tilting adjustment of the tamper.

DESCRIPTION OF THE PREFERRED EMBODIMENT

Figure 1:
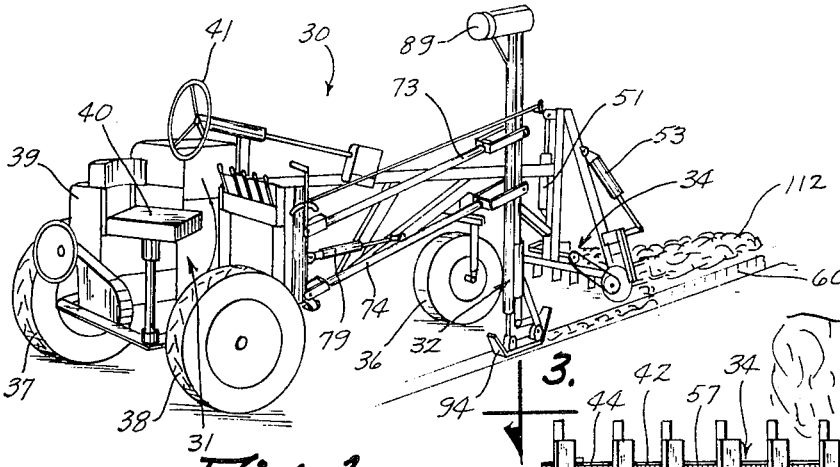
FIG. 1 is a perspective view illustrating a trench filler and tamper in accordance with the preferred embodiment of the invention.

The preferred embodiment of the invention, and the operation thereof, will be described below with reference to the several views of the drawings. It will be apparent that a great many variations and modifications could be made to the structure depicted in the drawings without departing from the concept of the invention, and the following detailed description is merely exemplary thereof.

FIGS. 1, 2, 18, 19, 20 and 21 illustrate the overall device of the invention from various angles and with the major components thereof in different relative positions.

Figure 2:
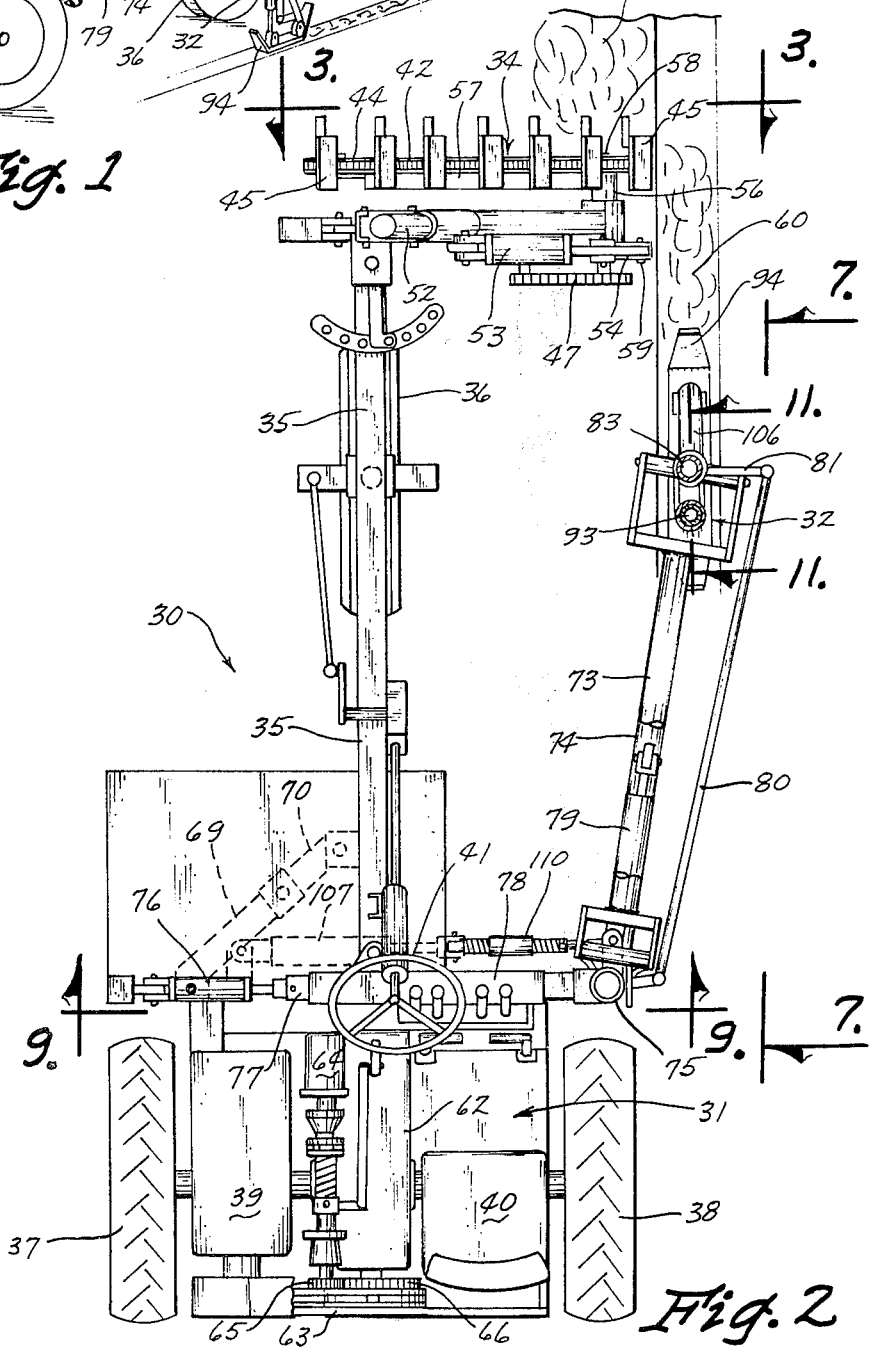
FIG. 2 is a top plan view thereof.

Referring specifically to FIGS. 1 and 2, the overall device is shown generally at 30, and includes a main vehicle section 31, a reciprocal tamping unit 32, a supporting post 83 attached to the main vehicle section 31 and carrying the tamping unit 32, a drag conveyor 34, and a pivotable boom 35 extending from the main vehicle section 31 and supporting the drag conveyor 34.

A steerable wheel 36 positioned between the main vehicle section 31 and the drag conveyor 34 supports the forward end of the boom 35. A pair of drive wheels 37 and 38 on the main vehicle section 31 are driven by engine 39 through a drive train to be described in detail below. A seat 40 is provided at an operator position on the main vehicle section, and a steering wheel 41 controls steerable wheel 36 through appropriate steering linkage. Various operator controls are provided at the operator's position.

Trench Filling Device

Figure 3:
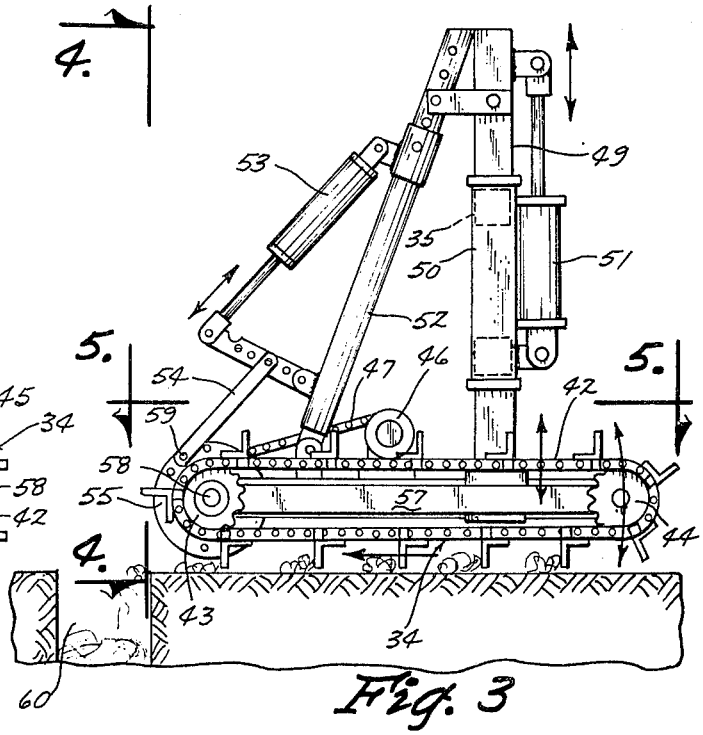
FIG. 3 is a front view of the trench filler portion taken along the line 3—3 of FIG. 2.

The trench filling device (drag conveyor 34) is shown in detail in FIGS. 2 – 6, and is comprised of an endless belt or chain 42 extending around a drive sprocket 43 and an idler sprocket 44 (FIG. 3). The belt 42 has a plurality of blades 45 spaced about its extent, as seen in any of FIGS. 2 – 6. The drag conveyor 34 is powered by a reversible hydraulic motor 46 (FIG. 5) acting through a chain and sprocket assembly 47 and shaft 48 (FIG. 4) to provide rotation to drive sprocket 43.

Figure 4:
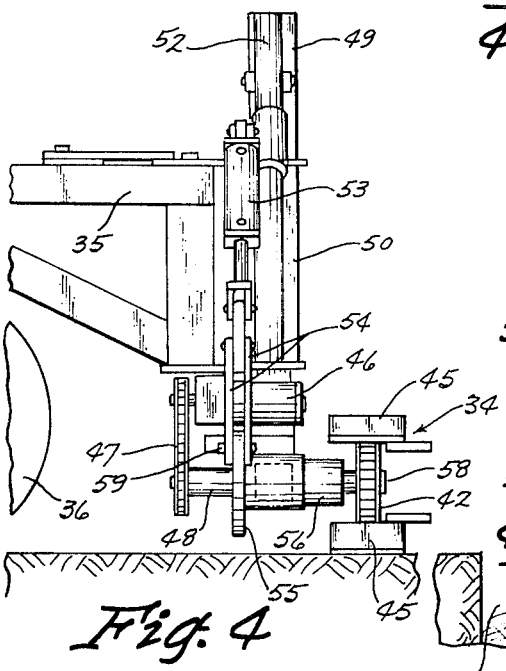
FIG. 4 is a side view of the trench filler taken along the line 4—4 of FIG. 3.

The drag conveyor is supported from the forward end of pivotable boom 35, as best seen in FIGS. 2 – 4. A column 49 (FIG. 3) extends through a sleeve 50 comprising the forward end of pivotable boom 35, and is vertically adjustable relative thereto by means of hydraulic cylinder 51 affixed at its base to sleeve 50 and at its piston to 49, all as clearly shown in FIG. 3.

A post 52 extends downwardly at an angle from the top of column 49. The drag conveyor 34 can be adjusted through a small angle relative to column 49 by extension or retraction of hydraulic cylinder 53 fixed at one end to post 52 and connected through linkage 54 (FIG. 3) to a circular plate 55 which is rigidly affixed to sleeve 56 (FIGS. 4 – 6) which in turn is connected to bar 57 (FIGS. 5 and 6) which supports idler sprocket 44. Thus, as indicated by arrows in FIG. 3, the entire drag conveyor unit 34 is vertically adjustable by operation of cylinder 51, and the angle of drag conveyor 34 is adjustable about a pivot point 58 by operation of cylinder 53.

Figure 5:
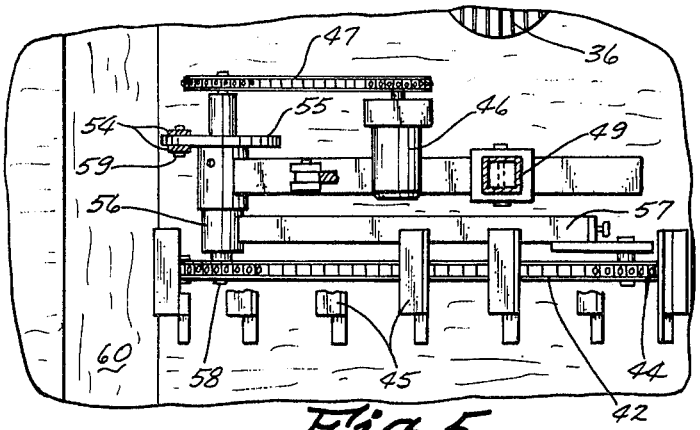
FIG. 5 is a cross-section taken along the line 5—5 of FIG. 3 showing the drag conveyor in its clockwise position.
Figure 6:
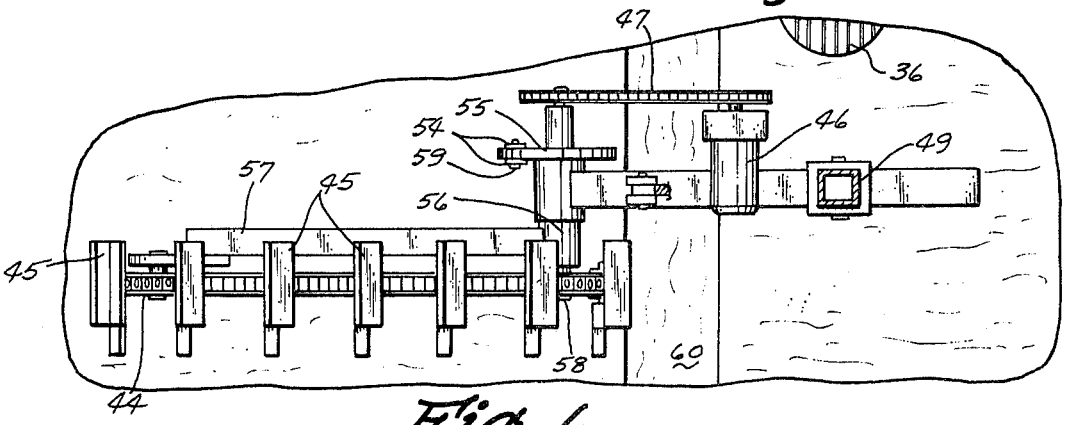
FIG. 6 is a cross-section similar to FIG. 5 but showing the drag conveyor pivoted to its counterclockwise position.

In addition to the small angular adjustment provided by cylinder 53 and linkage 54, the entire drag conveyor unit can be reversed from the position shown in FIG. 5 to the position shown in FIG. 6. This is accomplished by removing pin 59 from circular plate 55 and manually rotating the drag conveyor, including circular plate 55, sleeve 56, and support bar 57, 180° about pivot point 58 and then replacing pin 59 in an appropriate hole in plate 55. Since motor 46 is reversible, conveyor belt 42 and associated blades 45 can be caused to move in either direction so that the unit can fill a trench 60 (FIGS. 5 and 6) from either side thereof. This capability, along with the relative positioning of the main vehicle, the drag conveyor and the tamper to be described later, gives the overall device great versatility and flexibility of operation as regards terrain and/or obstacles.

Drive Train

Figure 15:
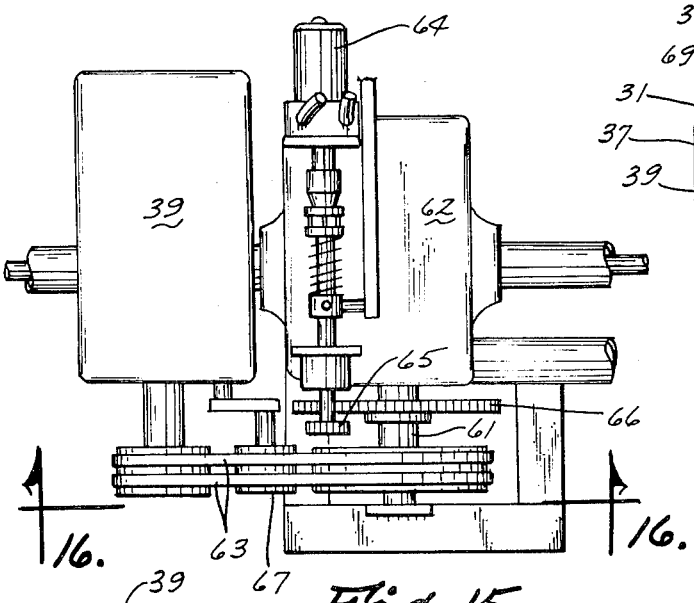
FIG. 15 is a top plan view illustrating the drive train of the vehicle.
Figure 17:
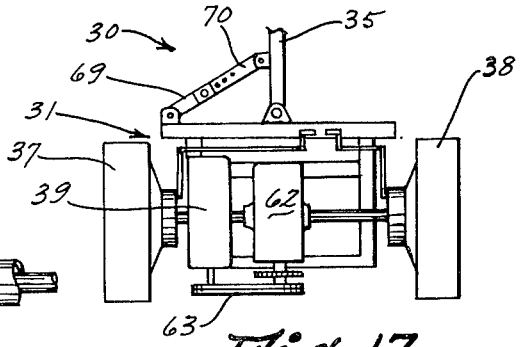
FIG. 17 is a top plan view of the vehicle drive train and main frame.
Figure 16:
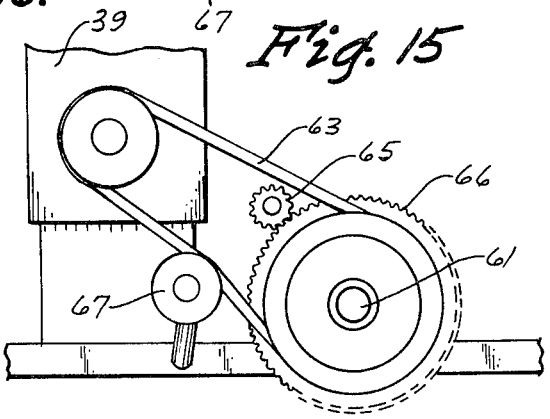
FIG. 16 is an end view taken along the line 16—16 of FIG. 15.
Figure 18:
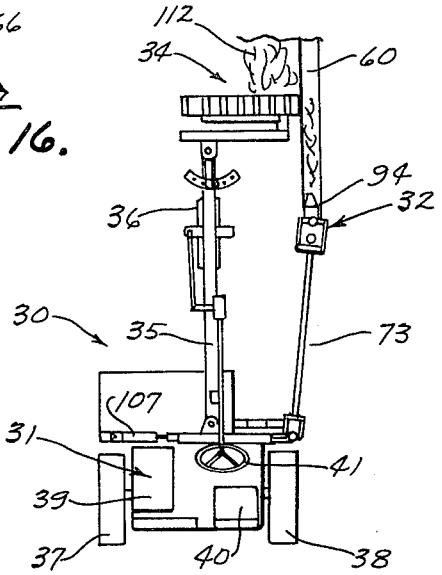
FIGS. 18 – 21 are top plan views of the device showing the tamper, the filler, and the pivotable boom in various operating positions.
Figure 21:
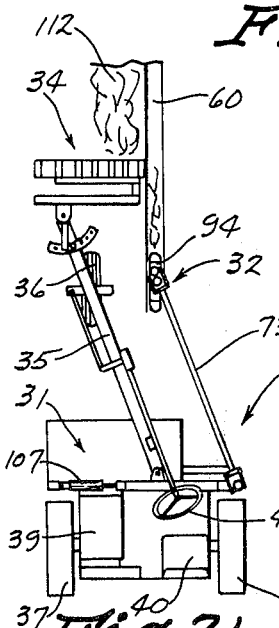
Figure 20:
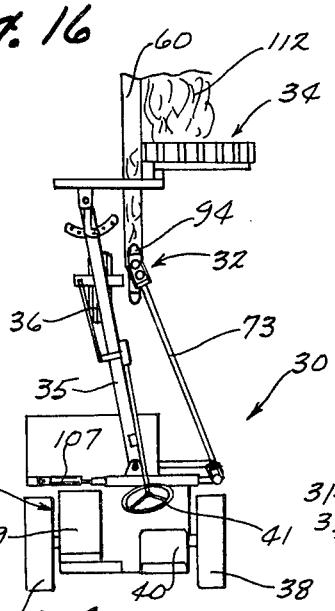
Figure 19:
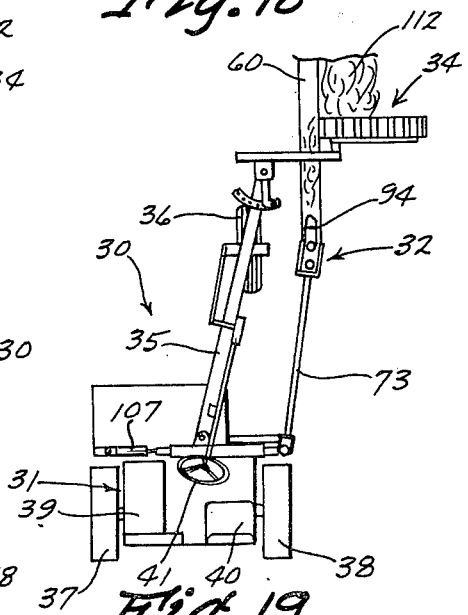

The drive train of the main vehicle section 31 is shown in detail in FIGS. 2, 15 and 16. This drive train will only be briefly described as it is not unlike drive trains used in other implement-carrying tractors. The engine 39 can selectively drive shaft 61 extending into transaxle 62 directly by belts 63 or indirectly through a hydraulic pump (not shown) powering reversible motor 64 connected to drive gear 65 engageable with driven gear 66. When the belts 63 are driving shaft 61, as shown in FIG. 16, the drive gear 65 is disengaged from driven gear 66 as seen in FIG. 15. When gears 65 and 66 are engaged, idler wheel 67 is moved out of contact with belts 63 and the belts 63 then slip loosely within their sheaves. Generally, the motor 64 and gears 65 and 66 are used to "creep" the device along a trench being filled and packed, and the belt drive is used for faster over-the-road or relocation travel.

Pivotable Boom

Figure 14:
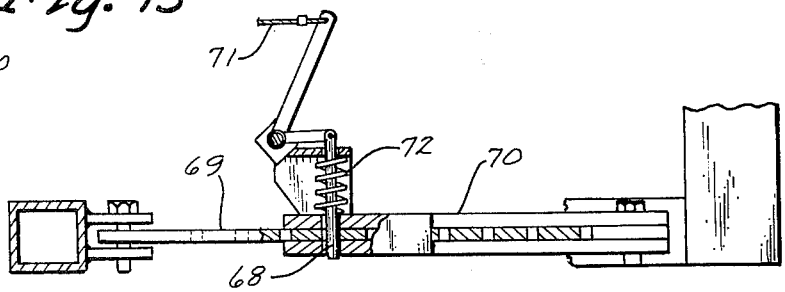
FIG. 14 is a view taken along the line 14—14 of FIG. 12 showing the releasable pin connection positioning the pivotable boom relative to the vehicle main frame.
Figure 12:
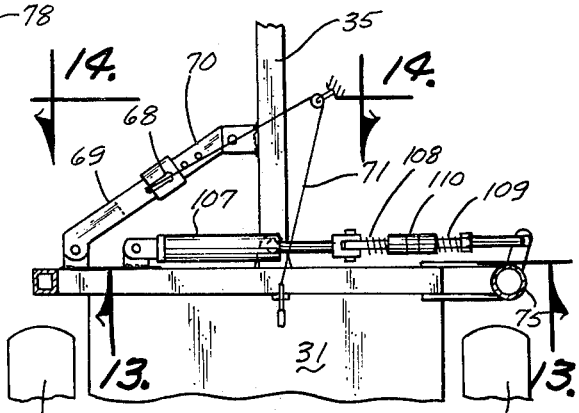
FIG. 12 is a cross-section taken along the line 12—12 of FIG. 7, showing the means for positioning the pivotable boom and the means for swinging the tamper relative to the vehicle.

The pivotal boom 35, and the releasable pin assembly for locking it in a desired position, is shown in FIGS. 2, 12 and 14. A spring loaded pin 68 (FIG. 14) is lifted out of mating perforations in bar 69 extending from the main vehicle section and bar 70 extending from the boom 35 by pulling of the pin release line 71. With the pin held out of engagement with holes in bars 69 and 70, the main vehicle section is pivoted relative to the boom by moving one main wheel slightly while braking the other main wheel. When the boom is at the desired angle relative to the main vehicle section, the pin release line is released and the spring 72 forces pin 68 into mating holes in bars 69 and 70. Alternately, the boom 35 could be pivoted by a hydraulic cylinder.

Tamper Support Means

The tamper support means extending from the main vehicle section 31 and carrying the tamper unit 32 is shown in FIGS. 2 and 7–10. The tamper support means includes a pair of arms 73 and 74 are located one above the other and extend from main vehicle section 31 to tamping unit 32, being fastened by pin connections at both ends, and being positioned one above the other. The arms 73 and 74 are connected to the main vehicle section through a post 75 which is pinned at its lower end (FIG. 9) and capable of tilting the tamper unit sideways in response to actuation of hydraulic cylinder 76 acting on bar 77 which is slidable within sleeve 78 forming a part of the supporting frame. As indicated in FIG. 10, the side tilt capability provided by the above structure enables the tamper to be used on a ditch that is cut at an angle relative to the ground surface. A hydraulic cylinder 79 extending from post 75 to lower arm 74 provides primary vertical adjustment for the tamper.

A structure is provided between arms 73 and 74 to provide lost motion along a substantially vertical axis between the arms 73 and 74 and the housing including post 83 and housing members 86 and 87. This lost motion structure is provided by a sleeve 82*a* which is slideably received on post 83. A pair of springs 82*b* and 82*c* are disposed above and below respectively of the sleeve 82*a* for the purpose of absorbing a portion of the shock between the sleeve 82 and the clamp 88 on the top; and, between the sleeve 82*a* and housing member 87 on the bottom.

A turning rod 80 (FIGS. 7 and 8) is adjustably mounted on post 75 and extends through short rod 81 to a sleeve 82 carried by tamper support post 83. The sleeve 82 is slideably mounted on post 83 and is rotatable about post 83 when turning rod 80 is moved. A pair of arms 84, 85 are welded to sleeve 82 and loosely embrace tamper housing 86. As will be explained below, housing 86 is freely movable vertically relative to arms 84 and 85. As clearly shown in FIG. 8, movement of turning rod 80 rotates sleeve 82 and arms 84 and 85 such that tamper housing 86 is selectively moveable and adjustable in an arc relative to post 83 for reasons to be explained more fully below.

The Tamping Unit

Figure 11:
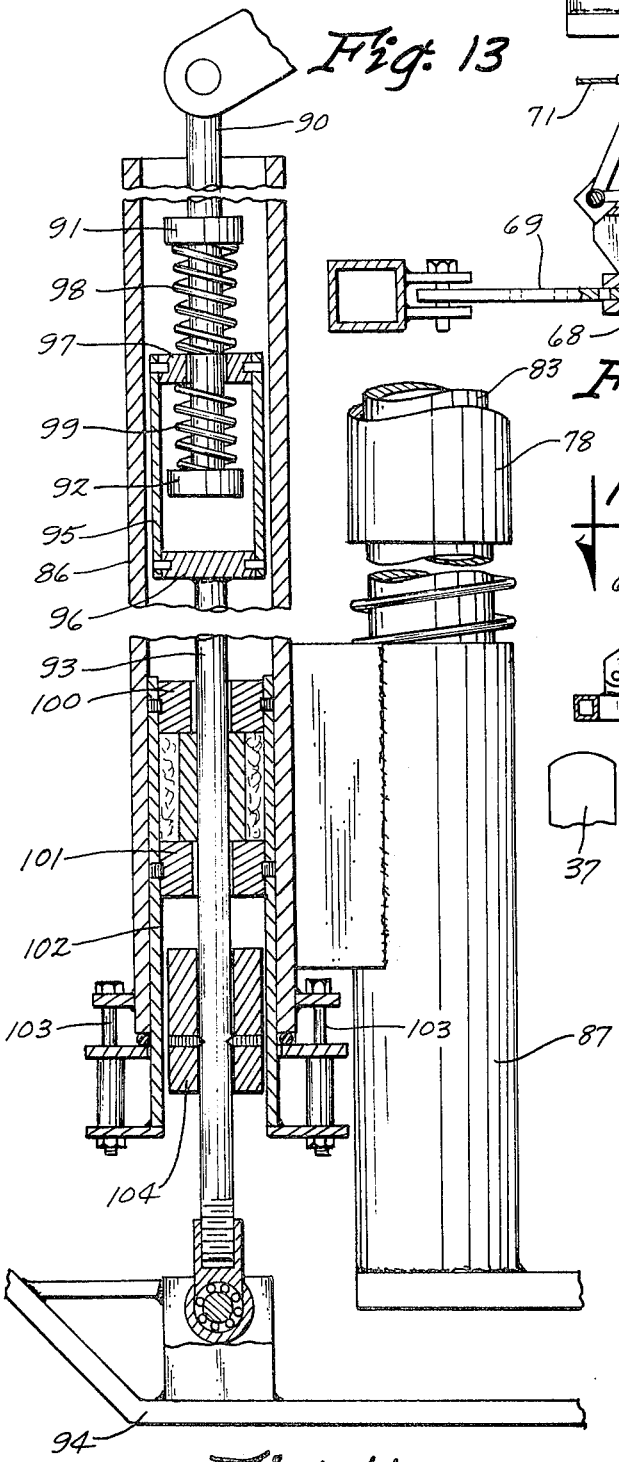
FIG. 11 is an enlarged cross-section taken along the line 11—11 of FIG. 2, showing internal details of the tamper.

The tamping unit 32 is illustrated in detail in FIGS. 7 and 11. Arms 73 and 74 attached to sleeve 82 have been previously mentioned, as has tamper support post 83. The tamper support post 83 extends at its lower end into lower sleeve 87 which is rigidly attached to the lower end of tamper housing 86. The upper end of housing 86 is attached to support post 83 by a clamp 88, which is vertically adjustable with respect to post 83. A motor 89 is mounted to the top of housing 86, and actuates a reciprocating plunger 90 (FIG. 11) in a known manner. Plunger 90 extends into the top of housing 86, and includes upper and lower collars 91 and 92. A drive shaft 93 extends most of the length of housing 86, and extends below its lower end to a bearing connection to tamping shoe 94. The upper end of shaft 93 comprises a cylinder 95 having a plate 96 as its bottom and a bushing 97 having a central opening through which plunger 90 extends. Upper and lower springs 98 and 99 provide a resilient connection between bushing 97 and plunger 90 such that both the up and the down strokes of plunger 90 are transmitted to shaft 93 by a resilient contact. Guide bushings 100 and 101 are attached to inner sleeve 102 which is attached to housing 86 by bolts 103. A dirt shield 104 is attached to shaft 93 near the lower end of housing 86. Tamping shoe 94 is pivotally supported at its forward end by pin 105 (FIG. 7) which is held relative to housing 86 by brace 106. Actuation of plunger 90 causes shoe 94 to oscillate through a small arc about pin 105 as seen in FIG. 7.

Lateral positioning of tamper 32 relative to main vehicle section 31 is provided by hydraulic cylinder 107 (FIGS. 2, 12 and 13); and springs 108 and 109 in sleeve 110 provide shock absorbing capability between tamper 32 and main vehicle section 31 during operation of the tamper.

As previously mentioned, actuation of turning rod 80 enables tamping shoe 94 to rotate horizontally relative to support sleeve 82*a* to allow alignment of tamping shoe 94 at various relative positions of main vehicle section 31 and tamper 32. It is to be understood that when rod 80 is used to rotate the sleeve 82 and thereby the elements 83, 86 and 87, which move together as though a unitary member, that this rotation is allowed because of the fact that support sleeve 82*a* is freely received on the support post 83. Consequently, the support sleeve 82*a* is freely moveable vertically along support post 83 and the post 83 is freely rotatable within the support sleeve 82*a* when the rod 80 is moved. This allows, of course, relative rotary motion between sleeve 82 and support sleeve 82*a* when rod 80 is moved.

Figure 22:
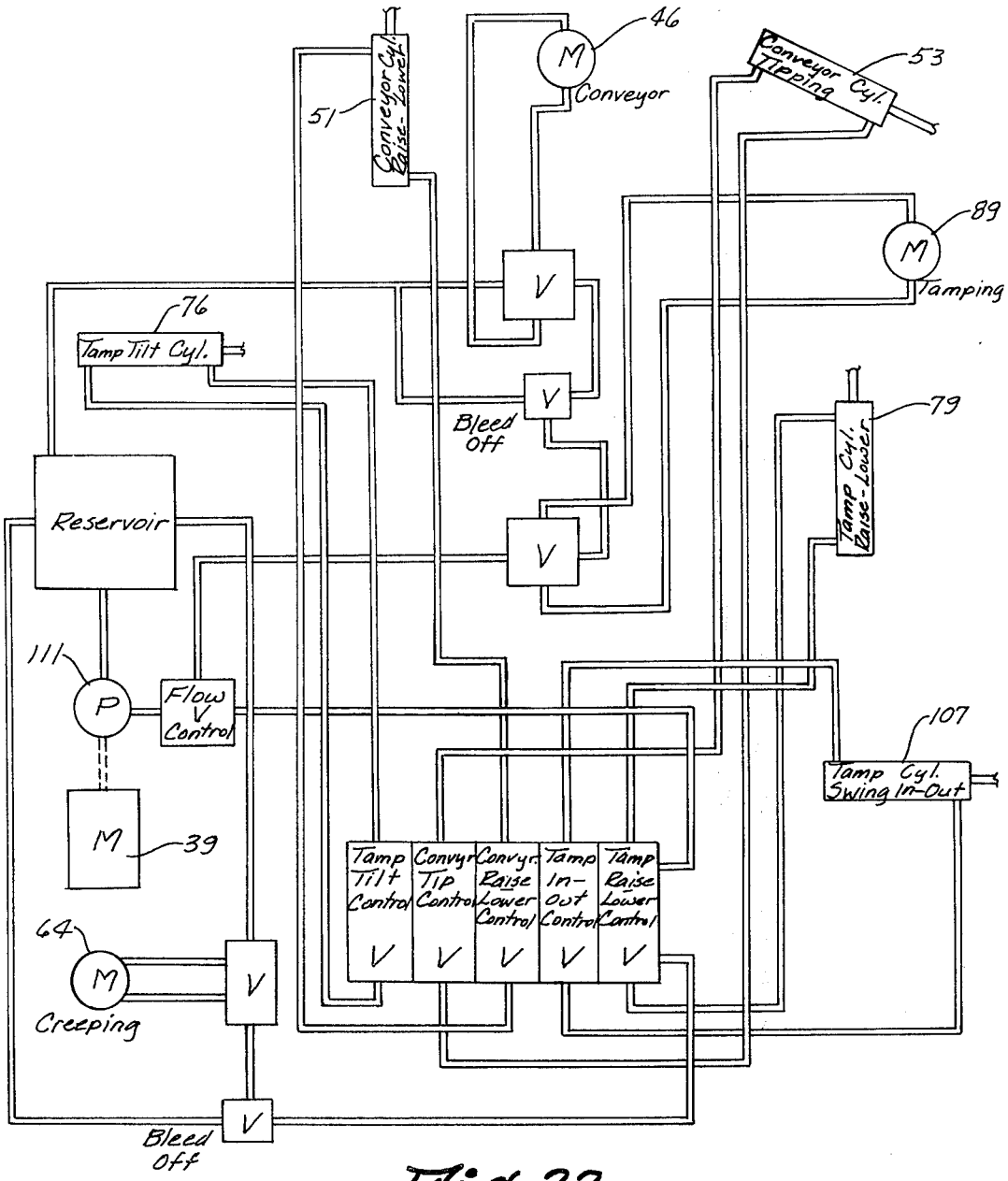
FIG. 22 is a schematic flow diagram of the hydraulic system for powering and controlling the device.

The control system for the device is schematically shown in FIG. 22. The motor 39 powers hydraulic pump 111 through conventional valving, piping and controls to supply hydraulic power as needed to operate the hydraulic motors and cylinders as represented in FIG. 22.

Operation of the Device

The operation of the preferred embodiment described above will now be briefly referred to, although the operation is generally apparent from the above description.

The device is transported and/or driven to the vicinity of the trench 60 to be filled. The drag conveyor 34 is positioned on either side of trench 60 by virtue of the "flip-over" feature shown in FIGS. 3–6. A pile of earth 112 (FIGS. 18–21) is then moved into a trench 60 by operation of drag conveyor 34. The vehicle is moved along the trench by the drive train shown in FIG. 15, and when sufficient fill has been moved into the trench the tamper is started. It is clear from FIGS. 18–21 that the main vehicle section 31 can operate either beside the trench or straddling it.

As a result of the many positions available for the tamper and the conveyor relative to the main vehicle section, the device can fill and tamp from a multitude of positions and in many situations where prior art devices would be unusable.

Figure 13:
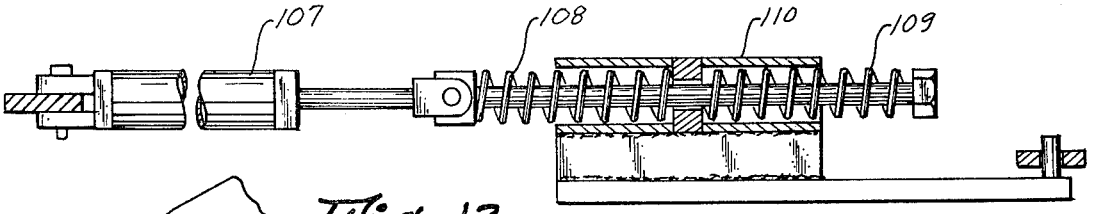
FIG. 13 is a view, partially cut away, taken along the line 13—13 of FIG. 12, showing details of an arrangement which allows the tamper shoe to float in a ditch during operation.

The main vehicle section is not subjected to jarring to the extent prior art devices are due to the resilient connection between plunger 90 and shaft 93, and the connection illustrated in FIG. 13.

The operator can tip the conveyor 34 by manipulation of the tip control valve depicted in FIG. 22. The conveyor can be raised or lowered by a similarly positioned valve. Also, the tamper can be moved up and down as well as in an out by appropriate manipulation of control valves. Likewise, the tamper can be tilted relative to the main vehicle by operation of the appropriate control valve.

In FIG. 7, the rear end or heel of the tamping shoe 94 would hit the ground and cause the tamping unit 32 to move up in the air. Once the tamp starts down, the heel would be in a raised position and the front end or toe of the shoe 94, on the forward upturned portion, would compact the loose dirt ahead of it. Immediately thereafter, the heel would hit and additionally compact what the toe has already partially compacted. This same operation occurs over and over in the present invention so that it actually appears to walk right up the ditch, hitting first the toe and then the heel in very rapid succession. During this operation, the support post 83 is constantly reciprocating within the sleeves 82 and 82*a*.

In instances where the trench to be filled is relatively deep, such that cylinder 79 acting on arm 74 cannot lower tamping shoe 94 sufficiently clamp 88 can be loosened, and the entire tamping unit including members 83, 86 and 87 can be lowered relative to support sleeve 82*a* (and arms 73 and 74) to enable tamping shoe 94 to tamp the dirt at the bottom of the deep trench.

The above description of the preferred embodiment of the invention is exemplary, rather than limiting. It is apparent that many details and elements thereof could be modified, or equivalent means substituted therefor, without departing from the true scope of the invention, which is to be defined by the appended claims.

I claim:

1. A device for tamping a trench comprising:

a supporting means;

a housing attached to said supporting means;

means for providing lost motion along a substantially vertical axis between the supporting means and the housing;

an elongated tamping shoe having an upturned portion on the forward end thereof, said tamping shoe being hingedly connected to said housing near the forward end thereof rearwardly of said upturned portion;

a drive shaft adapted for reciprocal movement within said housing, said drive shaft extending below said housing and being pivotally connected to a rearward portion of said tamping shoe; and reciprocating drive means resiliently connected to said drive shaft for imparting reciprocal movement thereto.

2. A tamping device according to claim 1 wherein the drive shaft has a bushing at its upper end with an axial opening therethrough, the reciprocating drive means extends through the opening, and separate spring means are provided on the drive means for contacting the upper and lower surfaces of said bushing.

3. A tamping device according to claim 1 including means for rotating the tamping shoe about an arc in a horizontal plane relative to the supporting means.

4. A tamping device according to claim 1 wherein the supporting means is attached to a vehicle and means are provided for adjusting the supporting means vertically and horizontally with respect thereto.

5. A tamping device as defined in claim 4 including a second lost motion means connected to said supporting means for allowing lost motion in the horizontal adjusting thereof, and a spring being disposed on each side of said lost motion means for biasing said supporting means to an intermediate position but allowing a slight horizontal movement from said intermediate position.

6. A tamping device according to claim 4 including means for tilting the tamping device from side-to-side relative to said vehicle.

7. A tamping device according to claim 1 wherein said lost motion means comprises a post rigidly attached to said housing and a sleeve slideably received on said post.

8. A tamping device according to claim 7 wherein a spring is disposed around the post on each end above and below said sleeve.

* * * * *